US006101945A

United States Patent [19]

Hara et al.

[11] Patent Number: 6,101,945

[45] Date of Patent: Aug. 15, 2000

[54] PRINTING PLATE OR PRINTED PRODUCT IDENTIFYING APPARATUS

[75] Inventors: Akira Hara, Tokyo; Yoshio Tsukamoto, Chigasaki; Takeo Onda, Fujimi, all of Japan

[73] Assignee: Baldwin-Japan, Ltd., Tokyo, Japan

[21] Appl. No.: 09/124,552

[22] Filed: Jul. 29, 1998

[30] Foreign Application Priority Data

Jul. 30, 1997 [JP] Japan ..... 9-219830

[51] Int. Cl.[7] ..... B41L 3/08

[52] U.S. Cl. ..... 101/486; 101/DIG. 36; 101/485; 33/621

[58] Field of Search ..... 101/DIG. 36, 484, 101/485, 477, 486, 415.1; 400/711; 33/614, 615, 617, 618, 619, 621, 623

[56] References Cited

U.S. PATENT DOCUMENTS 4,339,208 7/1982 Biedermann ..... 400/711

FOREIGN PATENT DOCUMENTS 4-308754 10/1992 Japan .
06023970 1/1994 Japan .

OTHER PUBLICATIONS

Abstract not Japanese Publication No. 06023970, Feb. 1, 1994.

*Primary Examiner*—Christopher A. Bennett
*Attorney, Agent, or Firm*—Morgan & Finnegan, LLP

[57] ABSTRACT

There is disclosed an apparatus for identifying a page of printing plate or printed product. The apparatus comprises reading head means for reading out at least one of items in a local descriptive portion of the page of printing plate or printed product. The apparatus further comprises identifying means for identifying the page of printing plate or printed product in accordance with the read out data transmitted from the reading head means.

11 Claims, 14 Drawing Sheets

PRINTING PLATE OR PRINTED PRODUCT IDENTIFYING APPARATUS

BACKGROUND OF THE INVENTION

1. Field of the Invention

The invention relates to an apparatus for identifying a page of printing plate or printed product to find and correct an error in page.

2. Description of Related Art

Preparatory to the printing of a printed product such as a newspaper, magazine, catalogue and the like which has some or many pages, a printing plate is processed for printing by a plate making apparatus after compilation and proof reading. The printing plate is then set up on a plate cylinder in a printing press for printing a web or sheets from page to page of printed product. Recently, the CTP (Computer to Plate) system has been commercialized in which the preparatory steps are computerized to automatically hard-copy the block copies and make an engraving onto the printing plate. It appears that in the future the CTC (Computer to Cylinder) system will be actualized which makes the engraving onto the printing plate set up on the plate cylinder in accordance with data transmitted from a computer.

In the case, however, if an operator finds an error in page of printed product after printing, it is required to correct the error in page in the preparatory steps and then start all the steps over again, taking labours and times, resulting in losses in film, printing plate and web or sheet. If the operator can not find the error in page, the printed products may be put on sale and transported. It is therefore required to call back the printed products having the error in page and resend the printed products after correcting, resulting in losses more and more.

Under the circumstances, it is desired to identify a page of printed product at many steps, so as to find and correct an error in page without taking labours and times and without resulting in losses. In this connection, it is unacceptable to put a bar cord on each page of printed product. Accordingly, a bar cord reader is unavailable to identify the page of printed product.

It is therefore an object of the invention to provide a new and improved apparatus for identifying a page of printing plate or printed product to find and correct an error in page, to overcome the above problems.

Another object of the invention is to identify a page of printing plate or printed product without putting an additional mark such as a bar cord on the page of printed product.

3. Summary of the Invention

According to the invention, there is provided an apparatus for identifying a page of printing plate or printed product. The apparatus comprises reading head means for reading out at least one of items in a local descriptive portion of the page of printing plate or printed product. The apparatus further comprises identifying means for identifying the page of printing plate or printed product in accordance with the read out data transmitted from the reading head means.

The item may include a character, brief description, mark, pattern or figure indicating the page, edition, version, kind or the like of printing plate or printed product.

The reading head means may comprise a CCD linear sensor and a light source which comprises LEDs.

In a preferred embodiment, the apparatus further comprises a managing system by which the position and range of the local descriptive portion is preset, the item in the local descriptive portion being previously stored as reference data in the managing system. The identifying means comprises comparing means for comparing the read out data transmitted from the reading head means with the reference data transmitted from the managing system to identify the page of printing plate or printed product.

The apparatus further comprises moving means for moving the reading head means longitudinally of the CCD linear sensor into a reading position corresponding to the local descriptive portion. The reading position is preset by the managing system.

The printing plate or printed product may be set up on a rotor. The CCD linear sensor extends axially of the rotor, the moving means moving the reading head means axially of the rotor into the reading position which is an axial position of the rotor. The local descriptive portion is defined with orthogonal axes X and Y of coordinates, one of the axes X extending axially of the rotor, the other axis Y extending circumferentially of the rotor. The reading head means has a reading range in one of the axes X, the reading range in one of the axes X being preset by the number of used pixel and the resolution of the CCD linear sensor. The reading head means starts to read out at a starting position in the other axis Y, a rotary encoder being mounted on the shaft of the rotor, the starting position in the other axis Y being preset by a counted value at a clock frequency synchronized with a signal output from the rotary encoder. The reading head means continues to read out within a reading range in the other axis Y, the reading range in the other axis Y being preset by a counted value in a preset dividing ratio of a frequency of the signal output from the rotary encoder.

The rotor may comprise a plate cylinder in a printing press, the printing plate being set up on the plate cylinder. The reading head means is located adjacent to the plate cylinder.

In another embodiment, the printing plate or printed product is fed in a feeding direction, the CCD linear sensor extending perpendicular to the feeding direction. The local descriptive portion is defined with orthogonal axes X and Y of coordinates, one of the axes X extending perpendicular to the feeding direction, the other axis Y extending parallel to the feeding direction. The reading head means starts to read out at a starting position in the other axis Y, the starting position in the other axis Y being preset by a counted value of scanning lines which start to be counted at the leading edge of the printing plate or printed product.

The reading head means may be located adjacent to a feed roller by which the printing plate is delivered from a plate making or direct plate making apparatus.

The reading head means may be located adjacent to a guide roller in a printing press.

The reading head means may be located adjacent to a passage through which the page of printed product is fed or dropped down in a saddle stitching book binder.

DETAILED DESCRIPTION OF THE PREFERRED EMBODIMENTS

Figure 1:
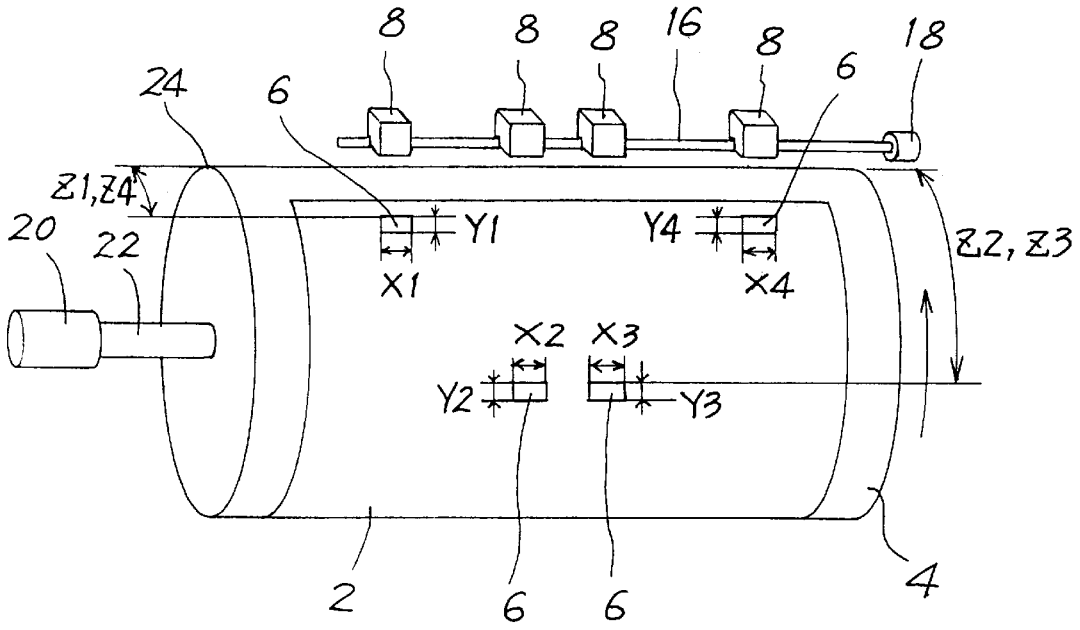
FIG. 1 is a shematically perspective view of a preferred embodiment of the invention.

Turning now to the drawings, FIG. 1 illustrates an apparatus for identifying a page of printing plate 2, according to the invention. The printing plate 2 is processed for printing to obtain a printed product such as a newspaper, magazine, catalogue and the like which has some or many pages. The printing plate 2 is set up on a rotor which comprises a plate cylinder 4 in a printing press. The plate cylinder 4 is then rotated about the axis thereof, as shown by an arrow, to print a web or sheets from page to page of printed product.

The apparatus comprises reading head means for reading out at least one of items in a local descriptive portion 6 of the page of printing plate 2. The item includes a character, brief description, mark, pattern or figure indicating the page, edition, version, kind or the like of printing plate 2. In the embodiment, the printing plate 2 has four pages to print four pages of printed product a time. The items are positioned in the local descriptive portions 6 in four pages of printing plate 2 or printed product, respectively. Accordingly, the reading head means comprises four reading heads 8 located adjacent to the plate cylinder 4 for reading out the items in the local descriptive portions 6 of four pages.

Figure 3:
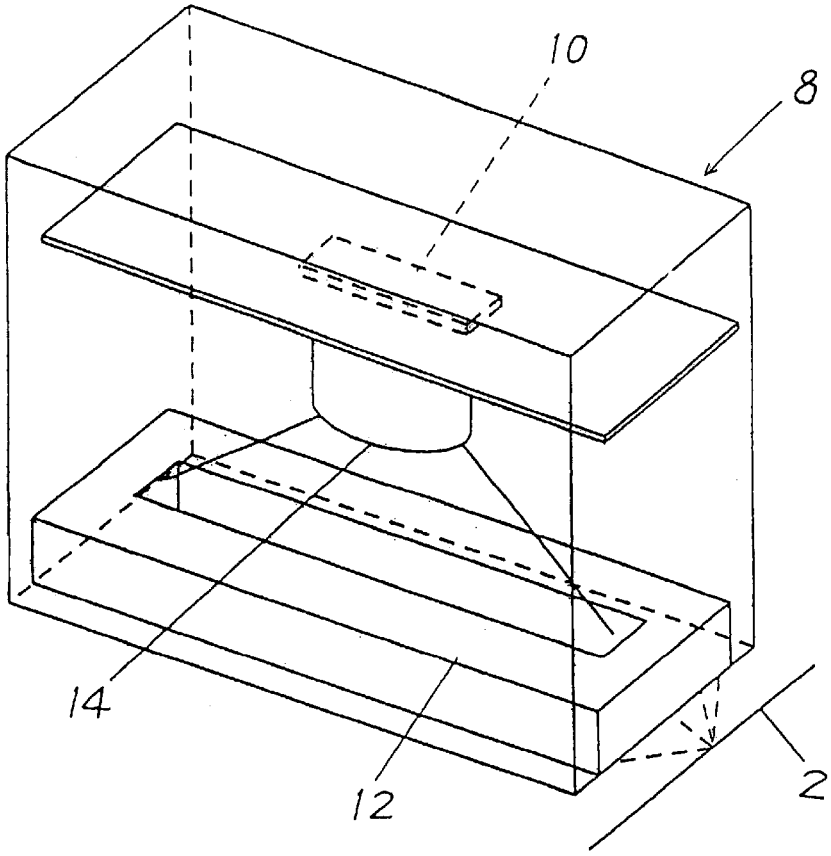
FIG. 3 is a schematically perspective view of the reading head of FIG. 1 and FIG. 2.
Figure 4:
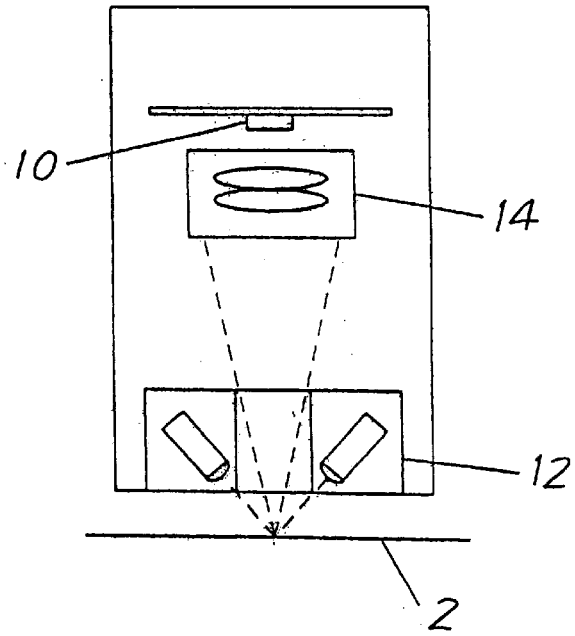
FIG. 4 is a schematically elevational view of the reading head of FIG. 3.

The reading heads 8 each comprises a CCD linear sensor 10, a CCD drive, an output substrate and a light source 12 which comprises LEDs, as shown in FIG. 3 and FIG. 4. The reading head 8 is disposed in position so that the CCD sensor 10 extends axially of the plate cylinder 4. The light source 12 is located adjacent to the printing plate 2 to direct a light to the surface of the printing plate 2. The light is reflected from the surface of the printing plate 2, focussed by lenses 14 and directed to the CCD linear sensor 10 so that the CCD linear sensor 10 can read out the item in the local descriptive portion 6 when the plate cylinder 4 is rotated to print the web or sheets.

The apparatus includes a managing system by which each of the positions and ranges of the local descriptive portions 6 is preset. The apparatus further includes moving means comprising a feed screw 16 extending axially of the plate cylinder 4. The feed screw 16 is connected to and rotated by a drive motor 18. The reading heads 8 each includes a nut member and a clutch not shown, the nut member being engaged with the feed screw 16. The nut member can be connected to the reading head 8 by engaging the clutch to move the reading head 8 axially of the plate cylinder 4 and longitudinally of the CCD linear sensor 10 into a reading position which is an axial position of the plate cylinder 4 corresponding to the local descriptive position 6. The nut member is then disconnected from the reading head 8 by disengaging the clutch to stop the reading head 8 at the reading position. The reading position is preset by the managing system. The drive motor 18 comprises a pulse motor so that the feed screw 16 can be controlled and rotated by the number of pulse to precisely move and stop the reading heads 8.

In each page of printing plate 2, the local descriptive portion 6 is defined with orthogonal axes X and Y of coordinates, one of the axes X extending axially of the plate cylinder 4, the other axis Y extending circumferentially of the plate cylinder 4. The reading heads 8 each has a reading range X1 to X4 in one of the axes X, the reading range X1 to X4 in one of the axes X being preset by the number of used pixel and the resolution of the CCD linear sensor 10.

While the plate cylinder 4 is rotated to print the web or sheets, the reading heads 8 each starts to read out at a starting position in the other axis Y. In this connection, a rotary encoder 20 is mounted on the shaft 22 of the plate cylinder 4. The starting position in the other axis Y is preset by a counted value at a clock frequency synchronized with a signal output from the rotary encoder 20. The counted value corresponds to a distance Z1 to Z4 between a phase position 24 of rotary encoder 20 and the starting position in the other axis Y. The reading heads 8 each continues to read out within a reading range Y1 to Y4 in the other axis Y. The reading range Y1 to Y4 in the other axis Y is preset by a counted value in a preset dividing ratio of a frequency of the signal output from the rotary encoder 20.

In a printing press including a rotor on which the printed product is set up, the apparatus can be arranged to identify a page of printed product after printing. The reading head means is used to read out at least one of items in a local descriptive portion of the page of printed product. Four reading heads 8 can be located adjacent to the rotor for reading out the items in the local descriptive portions of four pages, as in the case of reading heads 8 and printing plate 2 in FIG. 1.

Figure 2:
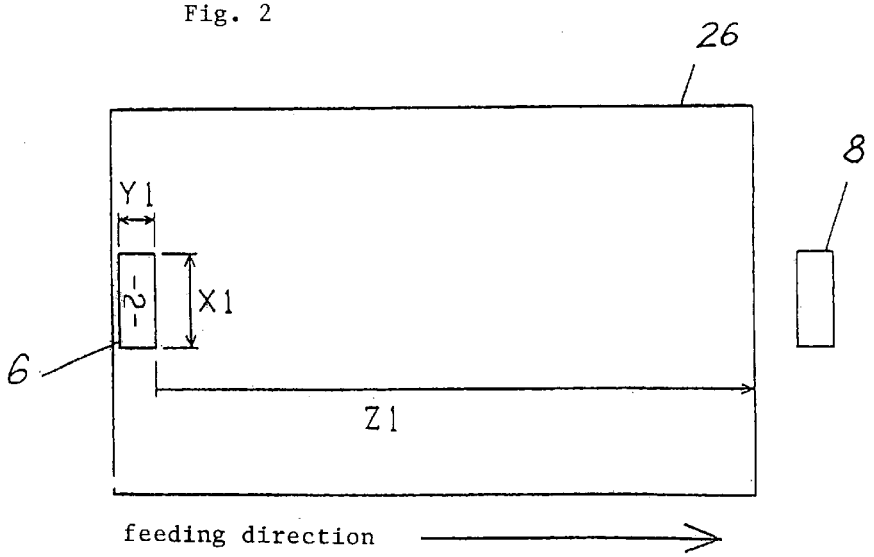
FIG. 2 is a schematically plan view of another embodiment.

In another embodiment shown in FIG. 2, the apparatus is arranged to identify a page of printed product 26 which is fed in a feeding direction by a feed roller after printing. The apparatus includes a reading head 8 for reading out at least one of items in a local descriptive portion 6 of the page of printed product 26. The item includes a character, brief description, mark, pattern or figure indicating the page, edition, version, kind or the like of printed product 26.

The reading head 8 comprises a CCD linear sensor 10, a CCD drive, an output substrate and a light source 12 which comprises LEDs, as in the embodiment in FIG. 1. The reading head 8 is disposed in position so that the CCD sensor 10 extends perpendicular to the feeding direction of printed product 26. The apparatus further includes moving means for moving the reading head 8 perpendicular to the feeding direction and longitudinally of the CCD linear sensor 10 into a reading position corresponding to the local descriptive position 6. The reading position is preset by the managing system.

In the embodiment, the local descriptive portion 6 is defined with orthogonal axes X and Y of coordinates, one of the axes X extending perpendicular to the feeding direction, the other axis Y extending parallel to the feeding direction. The reading head 8 has a reading range X1 in one of the axes X, the reading range X1 in one of the axes X being preset by the number of used pixel and resolution of the CCD linear sensor 10.

While the printed product 26 is fed in the feeding direction by the feed roller, the reading head 8 starts to read out at a starting position in the other axis Y. The starting position in the other axis Y is preset by a counted value of scanning lines which start to be counted at the leading edge of the printed product 26. The reading head 8 continues to read out within a reading range Y1 in the other axis Y. A rotary encoder is mounted on the shaft of the feed roller, the reading range Y1 in the other axis Y being preset by a counted value in a preset dividing ratio of a frequency of the signal output from the rotary encoder.

In the embodiment, the apparatus can be arranged to identify a page of printing plate which is fed in a feeding direction by a feed roller to be set up on the plate cylinder. In the case, the reading head 8 is used to read out at least one of items in a local descriptive portion of the page of printing plate.

In the embodiments in FIG. 1 and FIG. 2, the apparatus further includes identifying means for identifying the page of printing plate 2 or printed product 26 in accordance with the read out data transmitted from the reading head 8. In this connection, the item in the local descriptive portion is previously stored as reference data in the managing system. The identifying means comprises comparing means for comparing the read out data transmitted from the reading head means with the reference data transmitted from the managing system to identify the page of printing plate 2 or printed product 26. The managing system may be a centralized type which is installed in a printing factory to accomplish the printing process management, inclusive of control of printing press, cleaning device, dampening water supply, ink temperature adjustment, stacker, book binder, wrapping, binding, delivery and the like. The managing system may be alternatively a decentralized type which is installed in a printing factory to accomplish the printing process management independently of other control.

Figure 5:
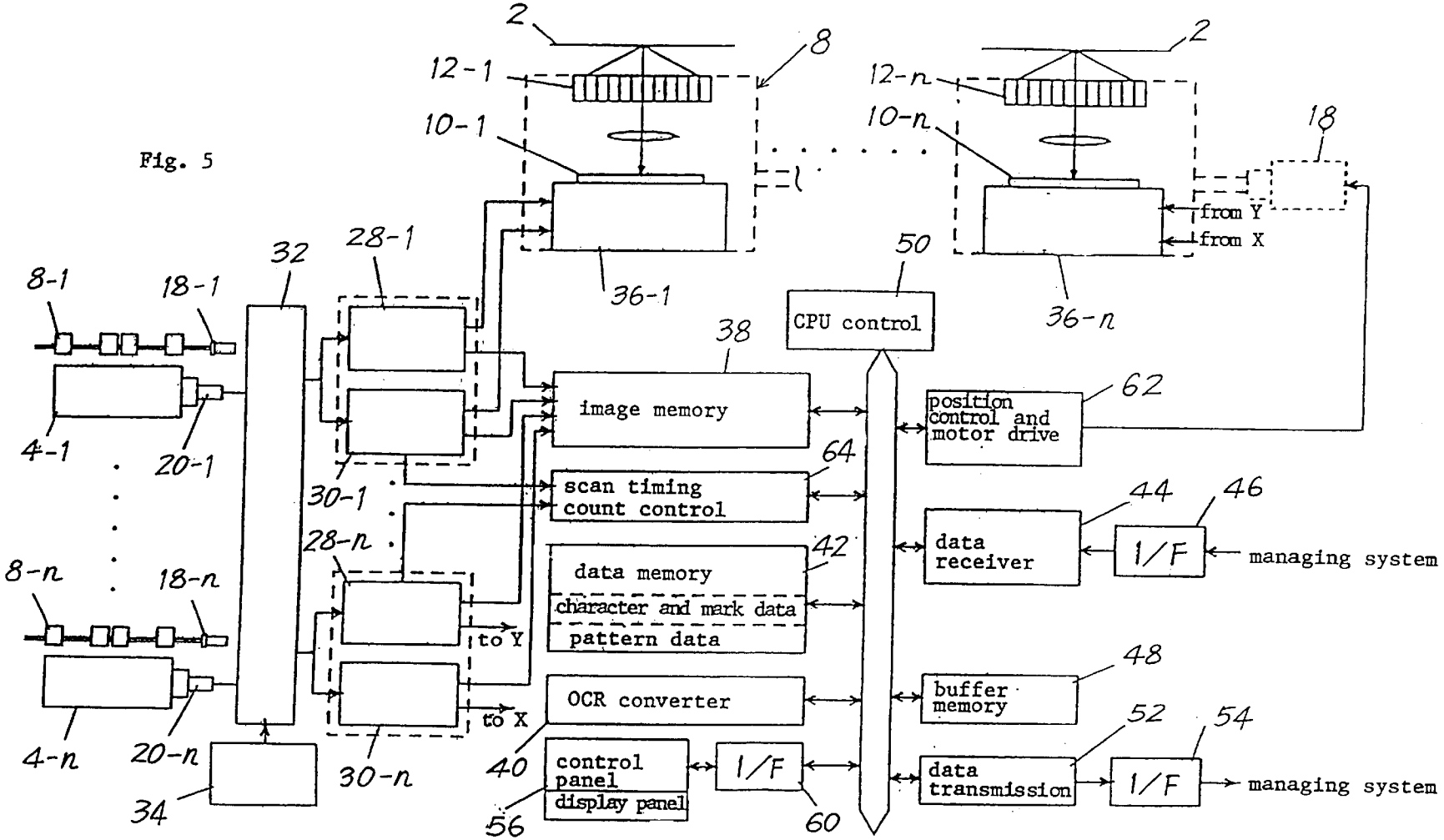
FIG. 5 is a block diagram of the elements in the apparatus of FIG. 1 and FIG. 2

FIG. 5 illustrates a preferred embodiment of the identifying means. In the embodiment, the apparatus are arranged to identify a page of each of printing plates or printed products 2 set up on rotors 4-1 to 4-n in a plurality of printing presses. The apparatus includes reading heads 8-1 to 8-n located adjacent to the the rotors 4-1 to 4-n to read out the items in the local descriptive portions of the pages of printing plates or printed products 2, respectively. The apparatus further includes drive motors 18-1 to 18-n for moving the reading heads 8-1 to 8-n axially of the rotors 4-1 to 4-n and stopping them at the reading positions. In each of the reading heads 8-1 to 8-n, the light source 12-1 to 12-n is located adjacent to the printing plate or printed product 2 to direct a light to the surface of the printing plate or product 2. The light is reflected from the surface of the printing plate or printed product 2 and directed to the CCD linear sensor 10-1 to 10-n.

In each of the reading heads 8-1 to 8-n, the CCD linear sensor 10-1 to 10-n is driven by a CCD driving signal transmitted from a multiplier 28-1 to 28-n. The CCD linear sensor 10-1 to 10-n scans the printing plate or printed product 2 and reads out the items within a reading range in response to a scanning timing signal transmitted from a frequency divider 30-1 to 30-n. In this connection, in each of the printing presses, a rotary encoder 20-1 to 20-n is mounted on the shaft of the rotor 4-1 to 4-n to generate an output signal. The multiplier 28-1 to 28-n and the frequency divider 30-1 to 30-n generate the CCD driving signal and the scanning timing signal in accordance with the signal output from the rotary encoder 20-1 to 20-n. The output signal is input to the multiplier 28-1 to 28-n or the frequency divider 30-1 to 30-n through a switching portion 32 along with a signal transmitted from a pseudo-signal generator 34. The multiplier 28-1 to 28-n increases the output frequency of the rotary encoder 20-1 to 20-n to generate the CCD driving signal. The frequency divider 30-1 to 30-n decreases the output frequency of the rotary encoder 20-1 to 20-n to generate the scanning timing signal.

In the embodiment, the CCD linear sensor 10-1 to 10-n reads out the items comprising characters, marks and patterns in the reading range and generate a read out signal which is processed in an output section 36-1 to 36-n and then transferred to and stored in an image memory 38. The read out signal is converted into read out data by a OCR converter 40. The read out data is transferred to and stored in a data memory 42 as character and mark data A and pattern data B. The character and mark data A and the pattern data B are accompanied with additional data C including an information of combination relating to the printing place number or press number of printing plate or printed product 2.

The managing system includes a reference table into which the coordinates of reading range are transformed, the coordinates of reading range being specified by the page number, the plate name and the image number, and a control table for extracting the data defined in the reference table during reading out. The reading range defined in the reference table is variable in accordance with the kind of printed product such as a newspaper, weekly magazine, monthly magazine, catalogue and the like. In this connection, the control table indicates what printing press is intended to utilize the data. The reference table and the control table are made by the information of combination.

Reference data are transferred to a data receiver 44 through an interface 46 from the managing system. The reference data comprise character and mark data D or pattern data E and additional data F. The additional data F include an information of combination relating to the press number or printing place number. The character and mark data D or pattern data E and the additional data F are tabulated in a buffer memory 48 and stored in the data memory 42.

The identifying means comprises an CPU control 50 which compares the character and mark data A or pattern data B and the additional data C read out from the printing plate or printed product 2 with the character and mark data D or pattern data E and the additional data F transmitted from the managing system and then determines whether they are coincident with each other or not to make "good" data G or "no good" data H.

The character and mark data A or pattern data B and the additional data C are transmitted to the managing system through a data transmission section 52 and an interface 54 along with the "good" data G or "no good" data H. In the case of "no good", a warning is given by a display panel 56 through an interface 60. An instruction is given by the printing managing system to stop the printing. An indication of "no good" may be given in the display panel 56 or a panel attached to the printing managing system.

As to the reading position in one of the axes X, the starting position in the other axis Y and the reading range in the other axis Y, the output signal is output from the rotary encoder 20-1 to 20-n mounted on the shaft of the rotor 4-1 to 4-n and processed in the multiplier 28-1 to 28-n and the frequency divider 30-1 to 30-n, as described above. The multiplier 28-1 to 28-n generates the clock signal for driving the CCD linear sensor. The frequency divider 30-1 to 30-n generates the scanning signal.

The drive motor 18 is pulse drivingly controlled by a position control and motor drive section 62. If the reading position in one of the axes X is preset to X mm from the left, the number of pulse is counted from the left to move the reading head 8 for X mm to the right and stop it in position. The starting position in the other axis Y is preset by the number of pulse of the scan timing signal, starting to be counted in accordance with a one pulse per rotation contained in the signal output from the rotary encoder 20. For example, if the starting position is preset to Y mm from the leading edge of the printing plate or printed product, it is obtained by (Y mm+the distance of N mm from the leading edge to the Z-phase signal output from the rotary encoder 20)×the resolution=the number of pulse.

The reading range in one of the axes X is preset by the number of pulse in the CCD driving signal. For example, if the reading range is preset to X mm, it is obtained by X mm×the resolution=the number of pulse. The reading range in the other axis Y is preset by a scan timing count control 64. For example, if the reading range is preset to Y mm, it is obtained by Y mm×the resolution=the number of pulse. However, the number of pixel of the CCD linear sensor 10 provides the maximum effective range. For example, if the number of pixel of the CCD linear sensor 10 is 1024, the maximum effective range is (1024/the resolution) mm.

The scan timing count control 64 counts the number of pulse of the scan timing signal from the frequency divider 30 after receiving an instruction to start the reading from the CPU control 50. When the number of pulse reaches the preset value, a notice is given to the CPU control 50 by the scan timing count control 64. The CPU control 50 causes the image memory 38 to store the read out data transmitted from the CCD linear sensor 10 until the number of pulse reaches the preset value.

The read out data of character or mark are all legible, as described below.

1. The characters and marks may be turned at an angle of 90° or 180° on the printing plate or printed product. In the case, the OCR converter can not convert it into code data. Accordingly, the read out data of character or mark are stored as image data and turned at an angle of 90° or 180° in the memory to be legible.

2. Even if a black-white inversion is mixed with non-inversion, it is legible in the apparatus. For example, when there are black characters and marks in a white background and white characters and marks in a black background, and the OCR converter can not convert it into code data, the read out data of character or mark are stored as image data and black-white inverted in the memory to be legible.

3. When an information of turned character and mark and black-white inversion is obtained by the additional data transmitted from the managing system, the read out data of character or mark can be processed every character and mark.

The apparatus can move the reading head 8 into the preset position to read out the item in a minimum range, resulting in the saving of memory capacity, and the miniaturization and simplification of reading heads 8. This reduces the cost of material. The reading heads 8 can be installed at many steps in the printing process by the miniaturization.

Figure 6:
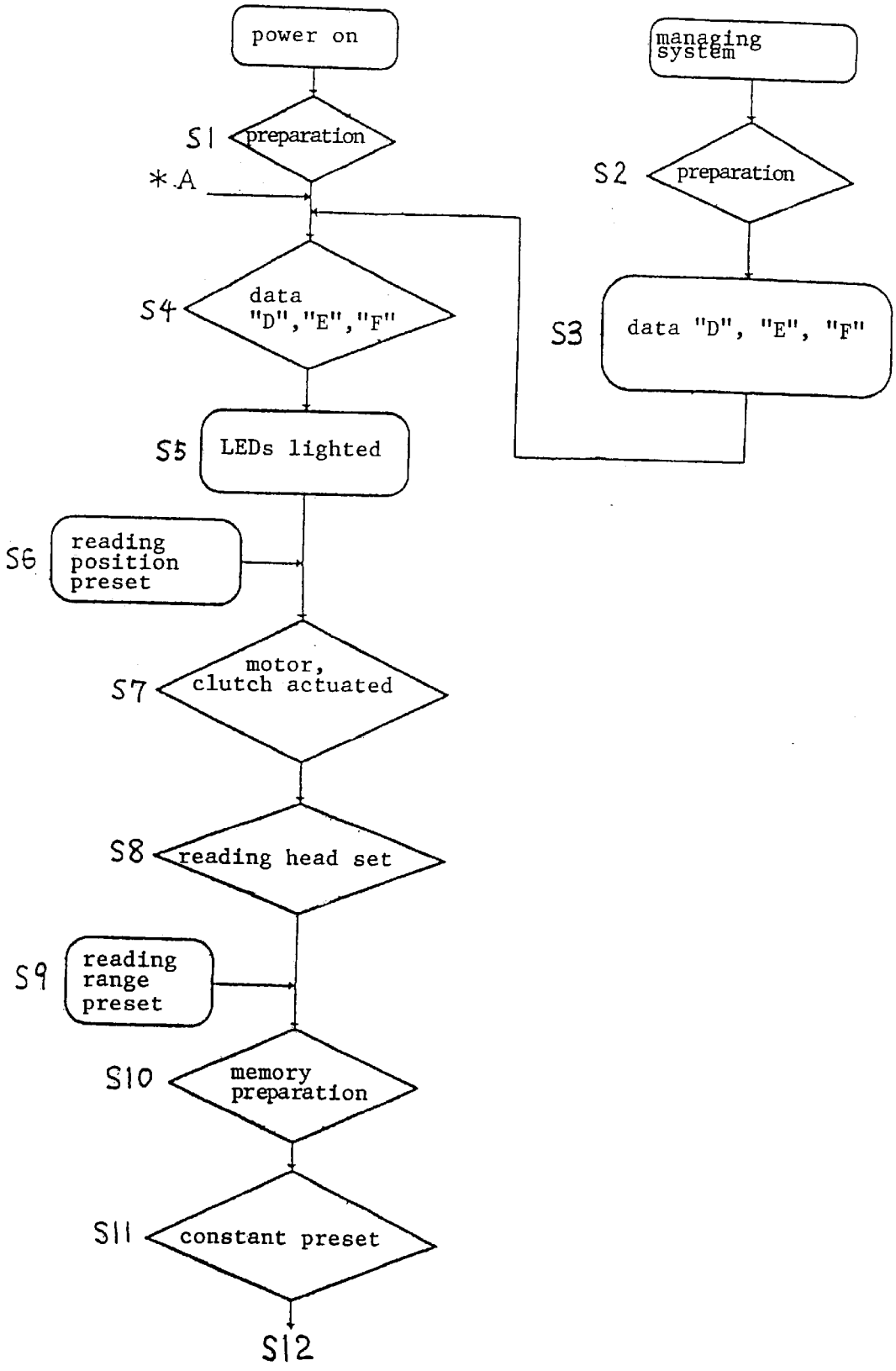
FIG. 6 is a flow chart of function for identifying in the apparatus of FIG. 1 and FIG. 2.

In operation, the CPU control is initialized to complete the preparation of identifying means (S1), as shown in FIG. 6. On the other hand, information is stored as reference data in the managing system to complete the preparation of managing system and wait for transmission (S2). The read out data comprise the character and mark data "A", the pattern data "B" and the additional data "C", while the reference data comprise the character and mark data "D", the pattern data "E" and the additional data "F", as described above. The additional data "C" include an information relating to the combination of the character and mark data "A" and the pattern data "B" with the plate number. The additional data "F" include an information relating to the combination of the character and mark data "D" and the pattern data "E" with the plate number.

The character and mark data "D", the pattern data "E" and the additional data "F" are transmitted from the managing system after the preparation of the identifying means (S3). The transmitted data "D", "E" and "F" are stored in the data memory 42 (S4). The LEDs are lighted in the reading head after storage of data (S5). At the same time, the reading position is preset in the position control 62 (S6). The motor 18 and clutch are actuated (S7) to move each reading head into the preset position and stop and set it at the preset position (S8).

Figure 7:
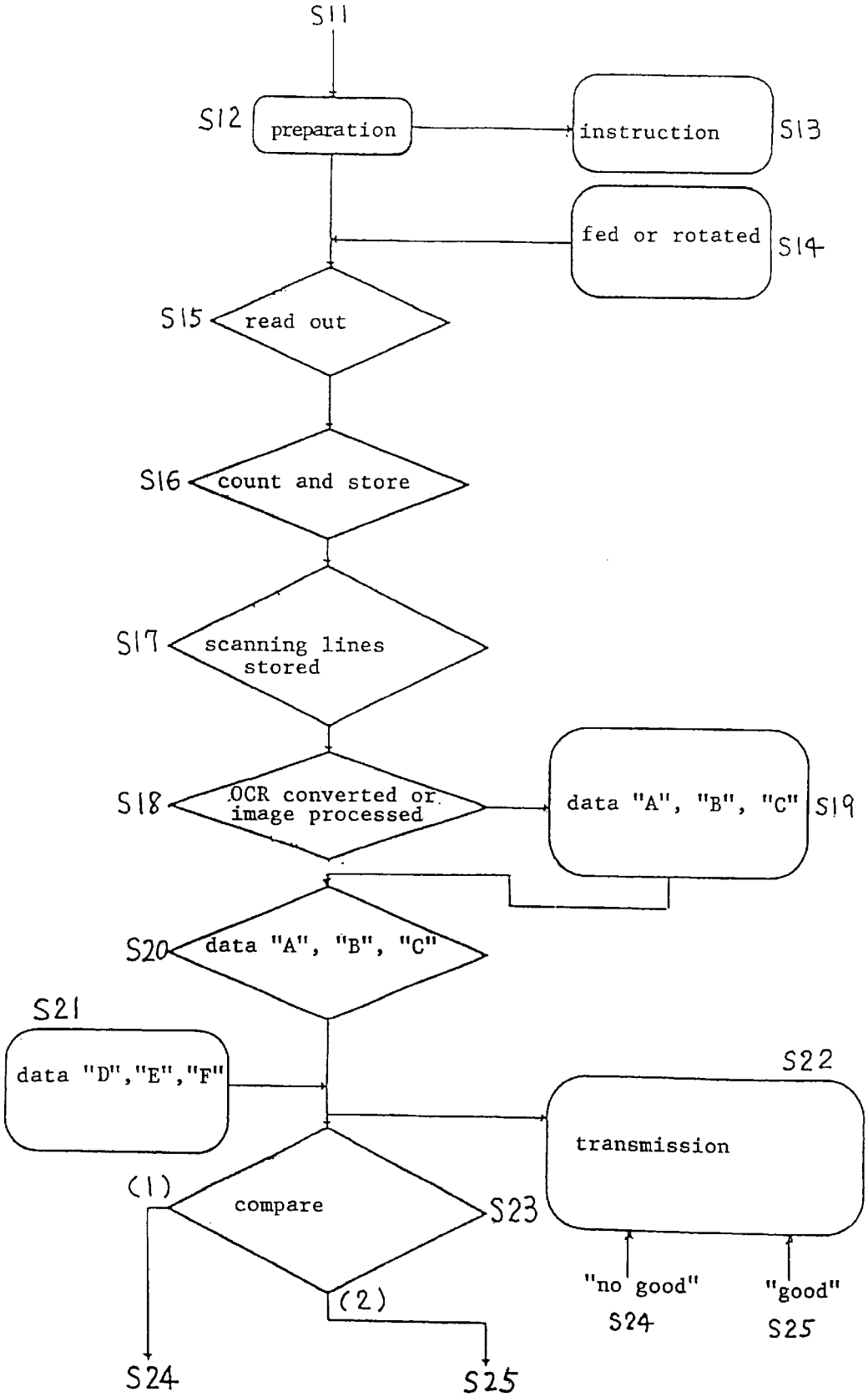
FIG. 7 is a flow chart continued from FIG. 6.

The reading range is then preset (S9) and calculated to complete the memory preparation (S10). A clock frequency dividing constant and a multiplication constant are automatically preset (S11). After the preparation for reading out (S12), an instruction is given (S13) so that the printing plate or printed product is fed or rotated, as shown in FIG. 7. While the printed plate or printed product is fed or rotated (S14), the reading head starts to read out (S15), starting to count and store the number of reading scanning lines (S16). The number of reading scanning lines is stored within the preset range of the reading head (S17). In the read out data, the character and mark data are OCR-converted, the pattern data being image processed, every reading head (S18).

Figure 8:
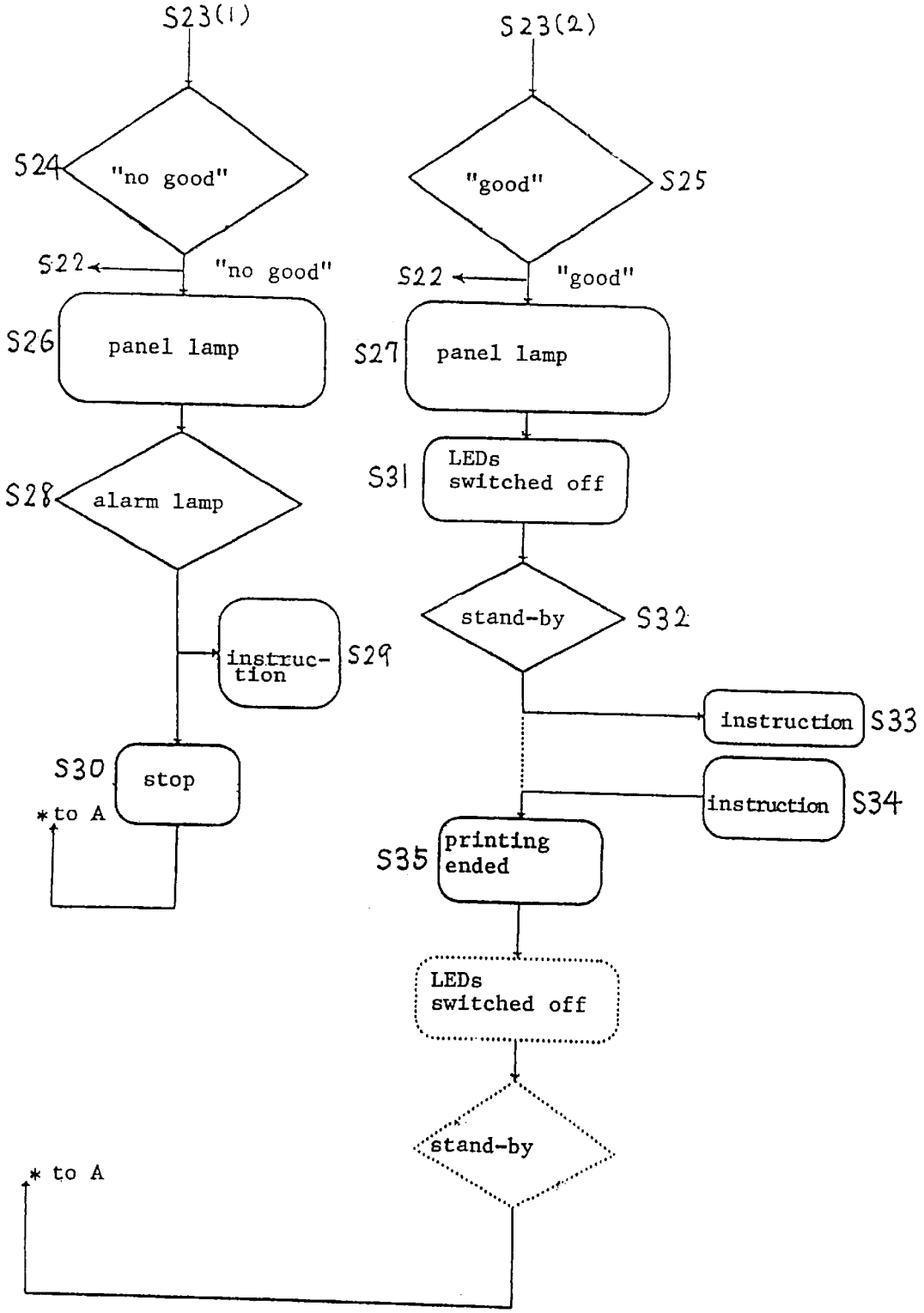
FIG. 8 is a flow chart continued from FIG. 7.

The character and mark data "A", the pattern data "B" and the additional data "C" are formed (S19) after the step S18 and stored in the data memory (S20). The stored data "D", "E" and "F" are called out from the memory (S21). The formed data are transmitted to the managing system (S22). The CPU control compares the formed data "A", "B" and "C" with the called out data "D", "E" and "F" (S23) and then determines it to be "no good" if they are not coincident with each other (S24), as shown in FIG. 8. The CPU control determines it to be "good" if they are coincident with each other (S25).

The "no good" data are transmitted to the control panel 56 when determining it to be "no good" at the step S24. The "good " data are transmitted to the control panel 56 when determining it to be "good" at the step S25. Lamps are lighted in the control panel to indicate to be "no good" or "good" in accordance with the "no good data" or "good data". In addition, lamps are lighted in the corresponding reading head to indicate to be "no good" when determining it to be "no good" (S26). Lamps are lighted in the corresponding reading head to indicate to be "good" when determining it to be "good" (S27).

An alarm lamp or sound is lighted or produced when the "no good" lamp is lighted (S28). An instruction is given (S29) to stop the printing or operation (S30). The control flow returns to the step S4 after stopping the printing or operation, to start to identify the next printing plate or printed product.

If the "good" lights are all lighted in the step S27, the LEDs are switched off (S31). The reading heads return to the stand-by state (S32). An instruction is given to start to print (S33).

When an instruction is then given to continue the printing (S34), the printing and operation is ended (S35), the control flow returning to the step S4. In the case of a saddle stitch bookbinder, it continues the reading without the steps S27 and S31. The LEDs are switched off in the reading head after the end of printing and operation in the step S35. The control flow returns to the step S4 after the reading head has returned to the stand-by state.

Figure 9:
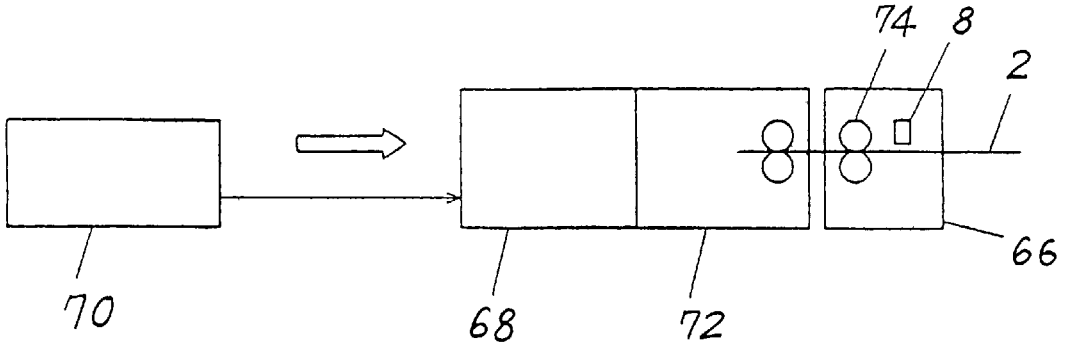
FIG. 9 is an explanatory view of other embodiment.

In other embodiment of the invention shown in FIG. 9, the identifying apparatus 66 is associated with a plate making apparatus 68 to identify a page of printing plate 2. The plate making apparatus 68 may comprise a direct plate making apparatus (Computer to Plate). A CPU system 70 constitutes a prepress system for making films or printing plates. The CPU system 70 is connected to the plate making apparatus 68 through an on-line or the like. The plate making apparatus 68 is arranged to record printing contents on films or printing plates. A processer 72 then performs processes such as development, fixation and water washing. The identifying apparatus 66 includes reading heads 8 which are located adjacent to a feed roller 74 by which the printing plate 2 is delivered from the plate making apparatus 68 through the processer 72. The reading heads 8 read out items such as characters, marks, or patterns in local descriptive portions of the pages of printing plate 2.

Figure 10:
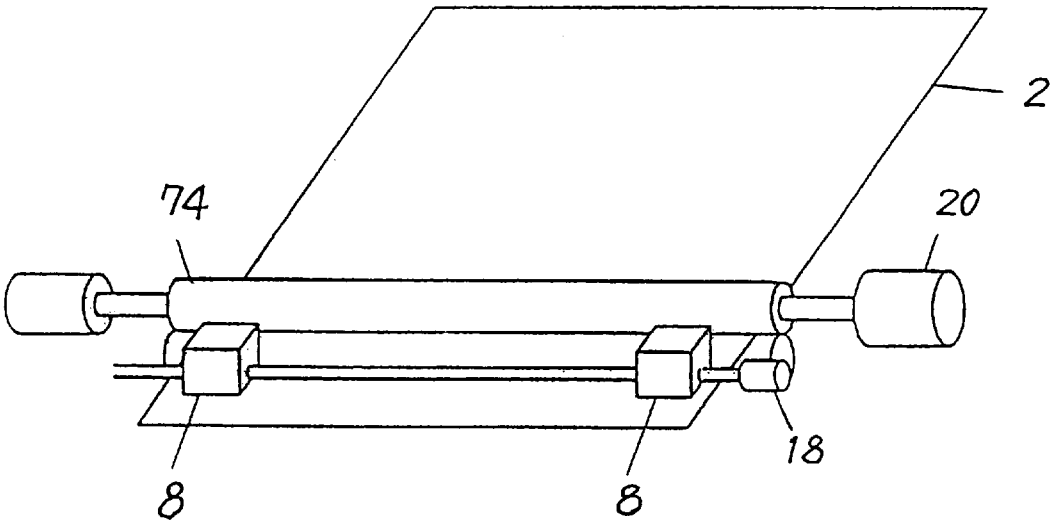
FIG. 10 is a schematically perspective view of the reading head in FIG. 9.

In the embodiment, a rotary encoder 20 is mounted on the shaft of the feed roller 74, as shown in FIG. 10. The reading heads 8 are synchronized with a signal output from the rotary encoder 20 to read out. The reading heads 8 each starts to read out at a starting position which is preset by a counted value of scanning lines which start to be counted at the leading edge of the printing plate 2. The identifying apparatus 66 is arranged to distinguish the number of printing press to which the printing plate 2 is fed, in accordance with the read out data, and indicate it to a system for feeding the printing plate 2.

The apparatus includes a drive motor 18 for moving the reading heads 8 into preset positions alternately to position and stand-by the reading heads 8 at the preset positions, before reading out. A feed screw is connected to the drive motor 18. The reading heads 8 each includes a clutch for moving and stopping. If there is enough time to read out the items in a plurality of portions of the printing plate 2, one of the reading heads 8 may only be used to read out the items in the preset ranges successively from the left end of the printing plate 2.

Figure 11:
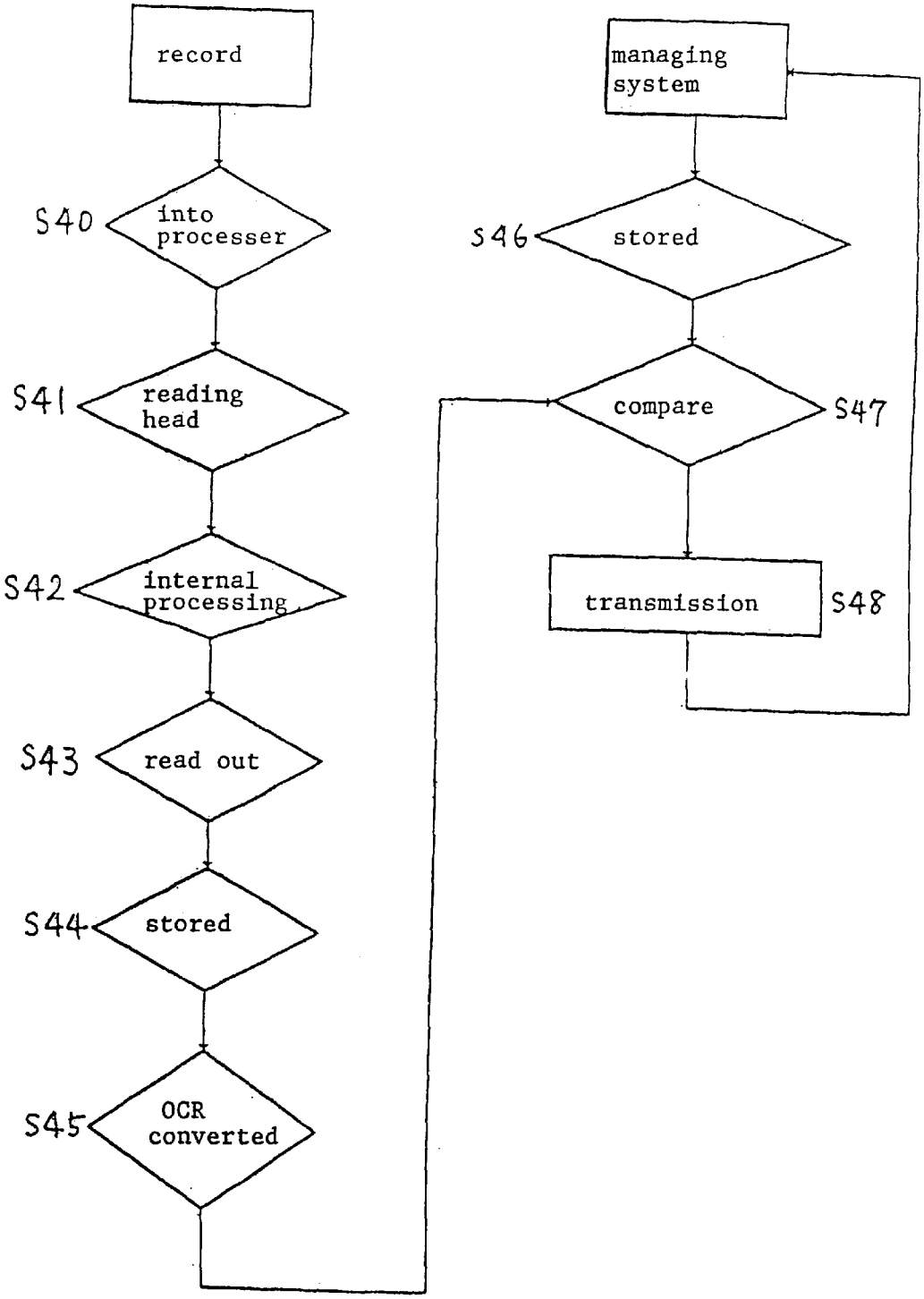
FIG. 11 is a flow chart of function for identifying in the apparatus in FIG. 9.

In the embodiment, the plate making apparatus starts to record the item such as a plate number onto the printing plate in addition to the process for printing, as shown in FIG. 11. The plate number indicates the printing press to which the printing plate is fed. The recorded plate is then fed into the processor 72 (S40). The apparatus moves the reading head into the preset position to stand-by (S41). After the internal processing of the processor (S42), the reading heads start to read out (S43), the read out data being stored in the memory (S44). The read out data is OCR-converted and/or image processed (S45).

In the plate feeding managing system, a plate feeding route is stored in the memory for determining the printing press to which the plate is fed (S46). The apparatus compares the OCR-converted and/or image processed data with the plate feeding route stored in the plate feeding managing system (S47), the comparing result being transmitted to the feeding control system (S48), the notice of the end of comparing being given to the plate feeding managing system. The feeding control system feeds the printing plate to the printing press through the transmitted feeding route. In the case of a plurality of printing plates, the above steps are successive to feed each plate to each press.

Figure 12:
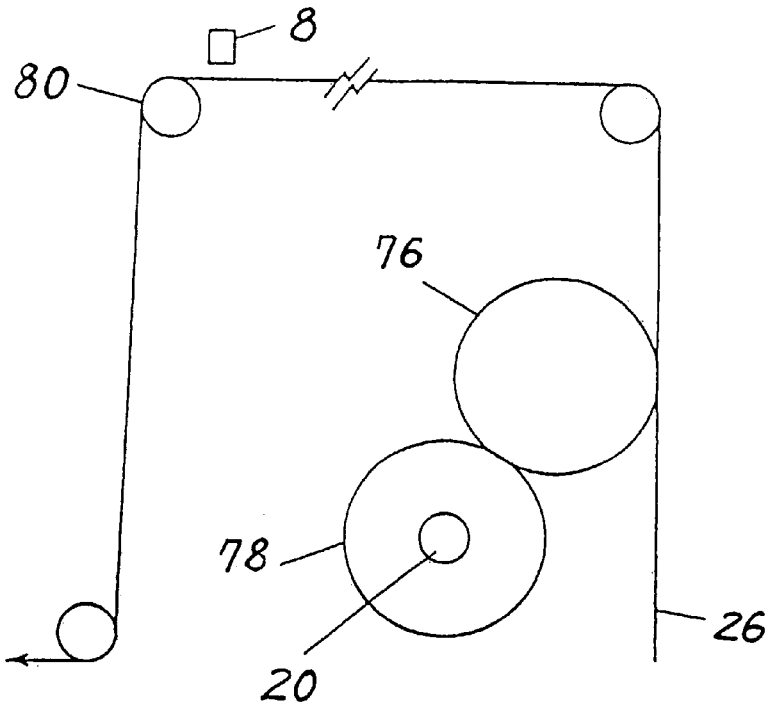
FIG. 12 is an explanatory view of other embodiment.
Figure 13:
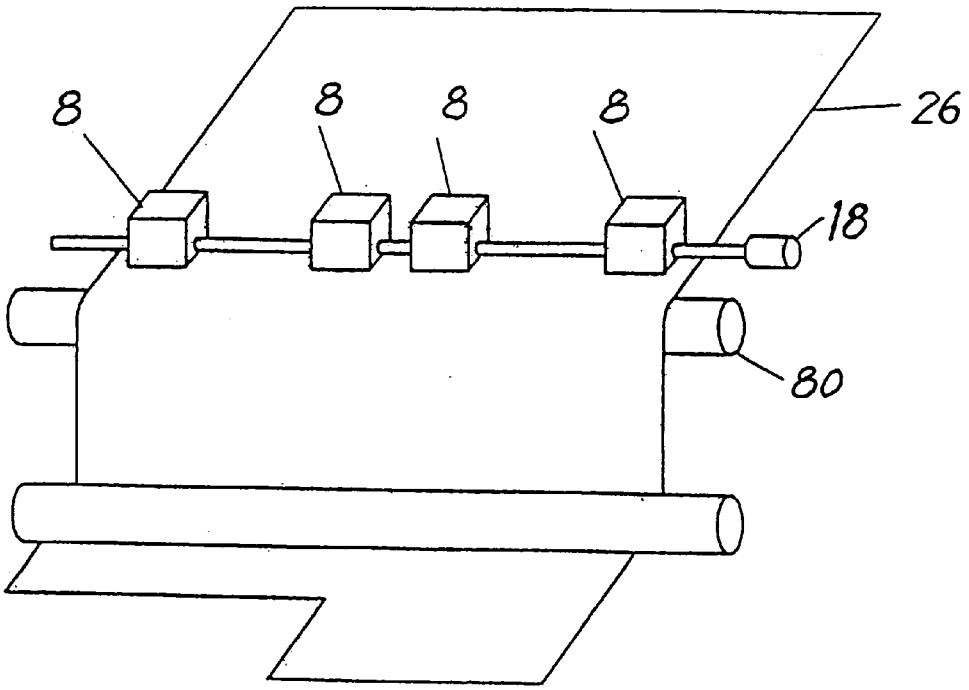
FIG. 13 is a schematically perspective view of the reading head in FIG. 12.

In other embodiment shown in FIG. 12, the apparatus is arranged to identify a page of printed product 26. The printed product 26 comprises a printed web of paper which is printed by a blanket cylinder 76 engaged with a plate cylinder 78 in a printing press. The printed web 26 is then fed through a guide roller 80. The apparatus includes reading heads 8 located adjacent to the guide roller 80 in the printing press, as shown in FIG. 13. A rotary encoder 20 is mounted on the shaft of the plate cylinder 78. The reading heads are synchronized with a signal output from the rotary encoder 20 to read out the items such as characters, marks or patterns within the preset ranges of printed web 26. The apparatus identifies the page of printed web 26 in accordance with the read out data transmitted from the reading heads 8. One of the reading heads 8 may only be used to read out the items as in the case of the apparatus shown in FIG. 10.

Figure 14:
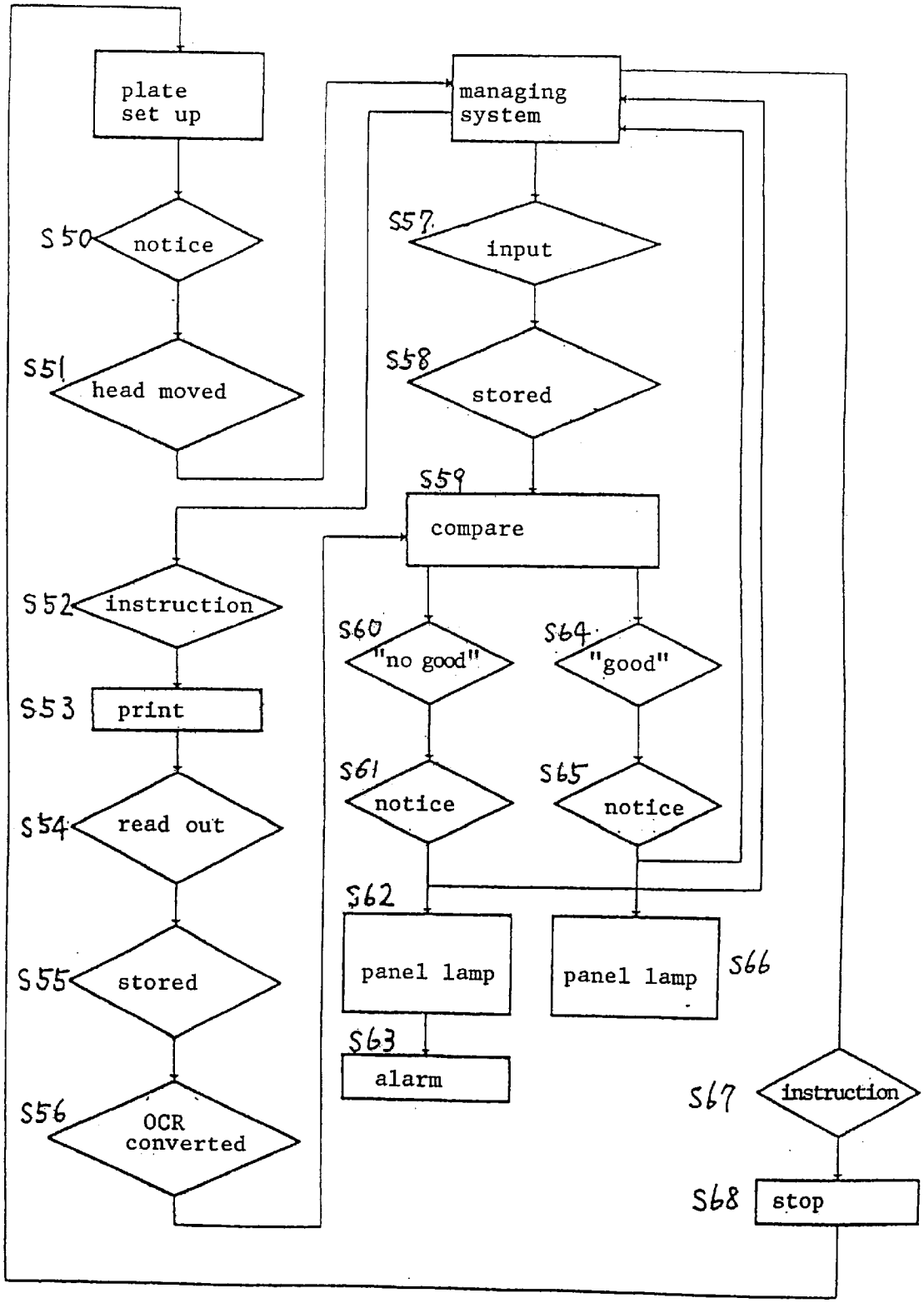
FIG. 14 is a flow chart of function for identifying in the apparatus in FIG. 12.

In the embodiment, the printing plate is set up on the plate cylinder, the notice of set up being given to the managing system (S50), as shown in FIG. 14. The apparatus moves the reading heads to the preset positions, the notice of movement being given to the managing system (S51). An instruction of printing is given to the printing press from the managing system (S52) to start the printing (S53). The reading heads start to read out (S54). The read out data are stored in the memory (S55) and OCR-converted and/or image processed (S56).

The information is input from the managing system (S57) and stored for reference data in the memory (S58). The apparatus compares the OCR-converted and/or image processed data with the reference data (S59) to determine it to be "no good" (S60) or "good" (S64). A notice is given to the managing system to stop the printing (S61) when determining it to be "no good", "no good" lamp being lighted for each plate cylinder on the control panel (S62), an alarm being given (S63). On the other hand, a notice is given to the managing system to continue the printing (S65) when determining it to be "good", "good" lamp being lighted for each plate cylinder on the control panel (S66). An instruction is given from the managing system (S67) to stop the press (S68) in the case of "no good".

Figure 15:
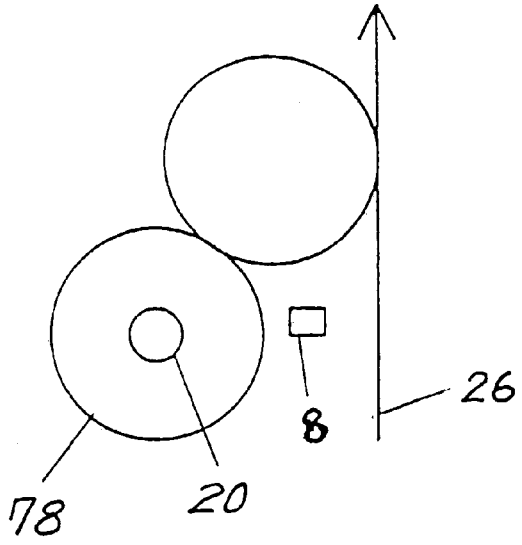
FIG. 15 is an eplanatory view of other embodiment.
Figure 16:
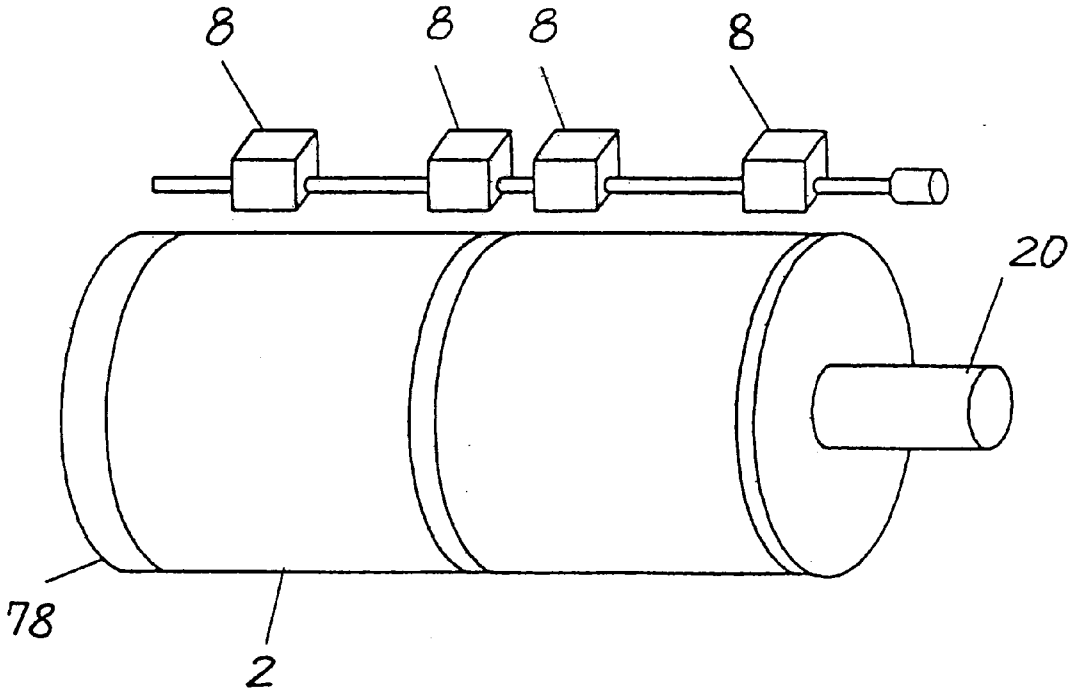
FIG. 16 is a schematically perspective view of the reading head in FIG. 15.

In other embodiment shown in FIG. 15, the apparatus is arranged to identify a page of printing plate 2 set up on the plate cylinder 78. The apparatus includes reading heads 8 located adjacent to the plate cylinder 78, as shown in FIG. 16. A rotary encoder 20 is mounted on the shaft of the plate cylinder 78. The reading heads are synchronized with a signal output from the rotary encoder 20 to read out the items such as characters, marks or patterns within the preset ranges of printing plate 2. The apparatus identifies the pages of printing plates 2 in accordance with the read out data transmitted from the reading heads 8. One of the reading heads 8 may only be used to read out the items as in the case of the apparatus shown in FIG. 10.

Figure 17:
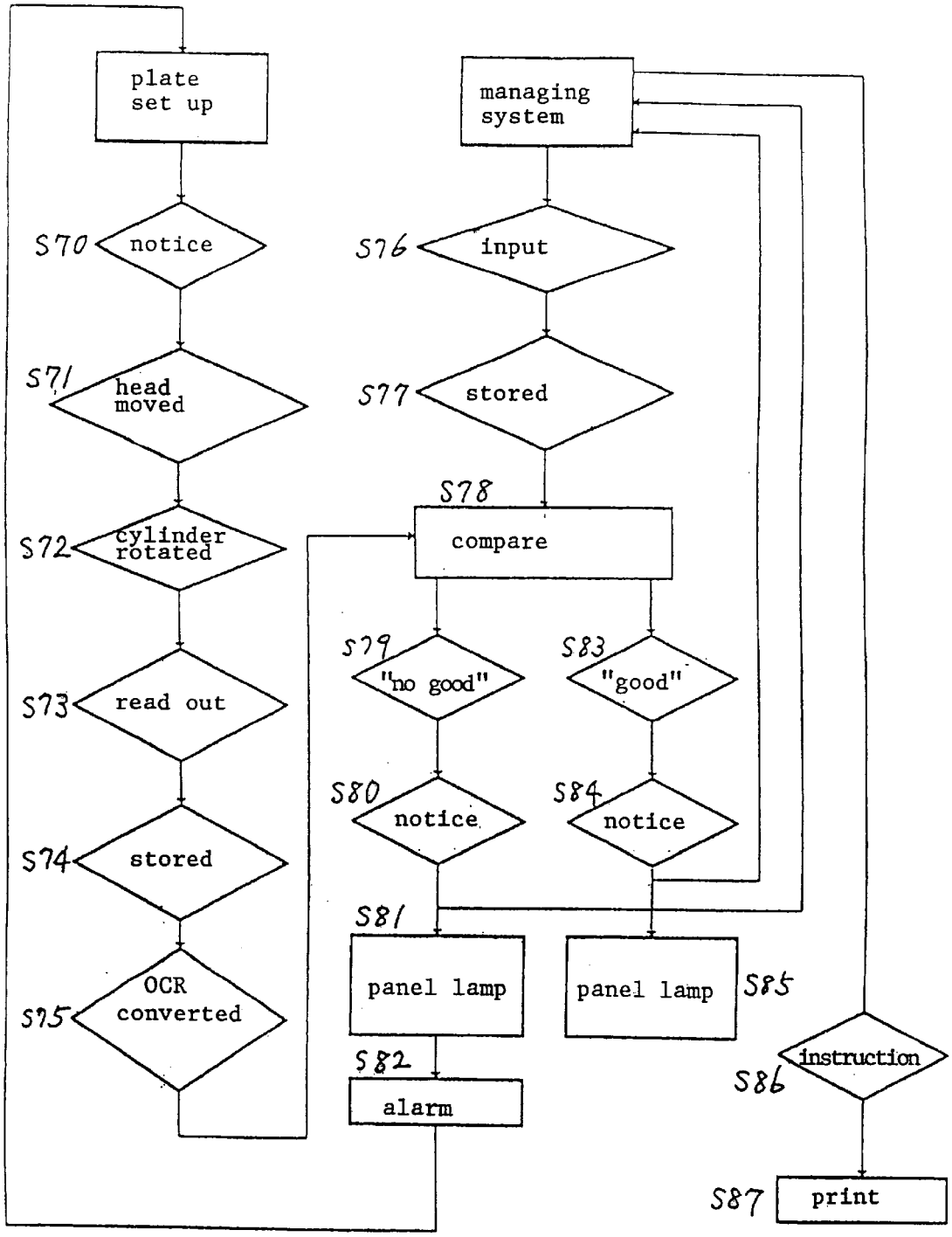
FIG. 17 is a flow chart of function for identifying in the apparatus in FIG. 15.

In the embodiment, the printing plate is set up on the plate cylinder, the notice of set up being given to the managing system (S70), as shown in FIG. 17. The apparatus moves the reading heads to the preset positions, the notice of movement being given to the managing system (S71). The apparatus rotates the plate cylinder on trial (S72). The reading heads start to read out (S73). The read out data are stored in the memory (S74) and OCR-converted and/or image processed (S75).

The information is input from the managing system (S76) and stored for reference data in the memory (77). The apparatus compares the OCR-converted and/or image processed data with the reference data (S78) to determine it to be "no good" (S79) or "good" (S83). A notice is given to the managing system to stop the printing (S80) when determining it to be "no good", "no good" lamp being lighted for each plate cylinder on the control panel (S81), an alarm being given (S82). The printing plate is exchanged, the apparatus re-starting the operation from step 70. On the other hand, a notice is given to the managing system to start the printing (S84) when determining it to be "good", "good" lamp being lighted for each plate cylinder on the control panel (S85). An instruction is given from the managing system (S86) to start the printing (87).

Figure 18:
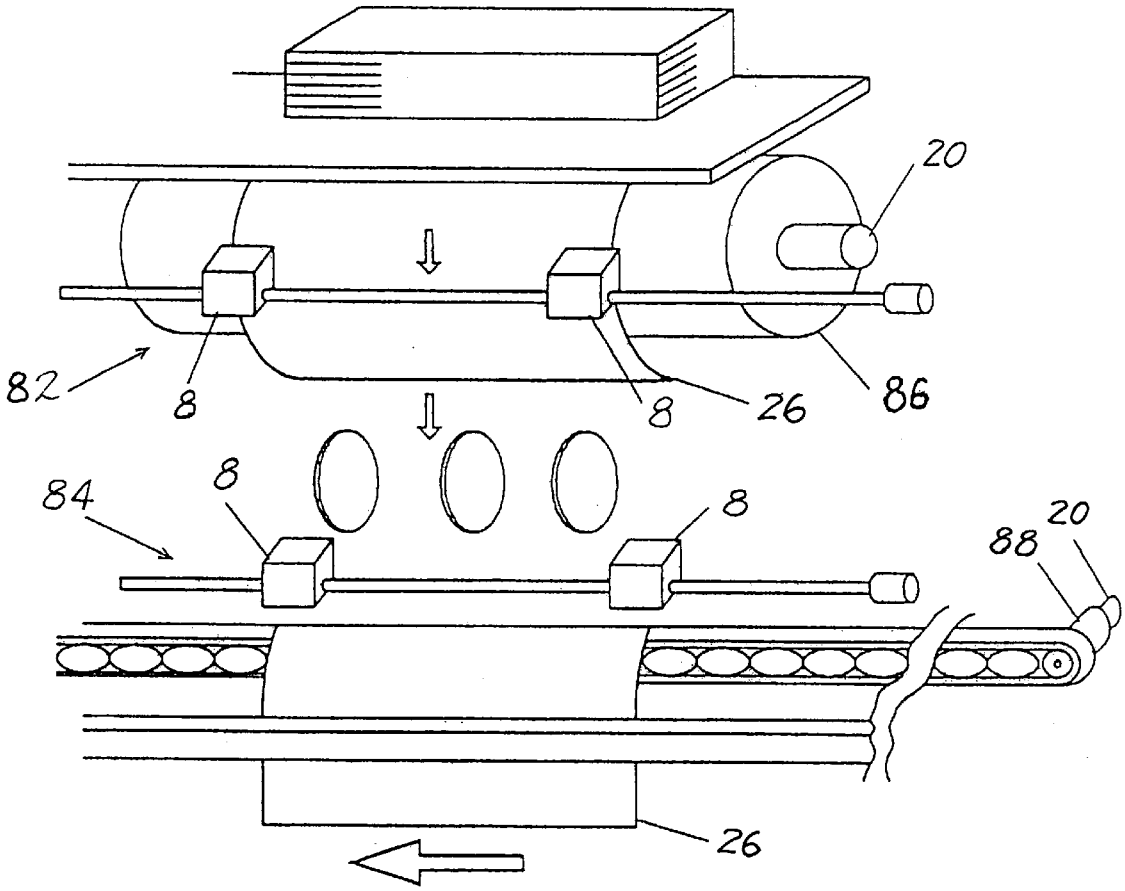
FIG. 18 is a schematically perspective view of other embodiment.

In other embodiment shown in FIG. 18, the apparatus is arranged to identify a page of printed product 26. The printed product 26 comprises printed sheets of paper which are grouped and stitched by a saddle stitching book binder. The apparatus includes reading heads 8 located adjacent to a passage through which the page of printed sheet 26 is fed or dropped down in the book binder. For example, two reading heads 8 are located in the feeding portion 82 of the book binder, two reading heads 8 being located in the dropping portion 84 of the book binder.

In the feeding portion 82, a rotary encoder 20 is mounted on the shaft of a guide roller 86 by which the printed sheet 26 is fed and dropped down, the reading heads 8 being synchronized with a signal output from the rotary encoder 20 to read out the items such as characters, marks or patterns within the preset ranges of printed sheet 26. In the dropping portion 84, a rotary encoder 20 is mounted on the shaft of a drive motor for driving a feed belt, the reading heads 8 being synchronized with a signal output from the rotary encoder 20 to read out the items of printed sheet 26. The apparatus identifies the pages of printed sheets 26 in accordance with the read out data transmitted from the reading heads 8. The apparatus may find the inversion, uneveness, slant and the like of printed sheet 26 and determine it to be "good" or "no good". The "good" data or "no good" data are transmitted to the managing system for the book binder. In each of the feeding portion 82 and the dropping portion 84, one of the reading heads 8 may only be used to read out the items as in the case of the apparatus shown in FIG. 10.

Figure 19:
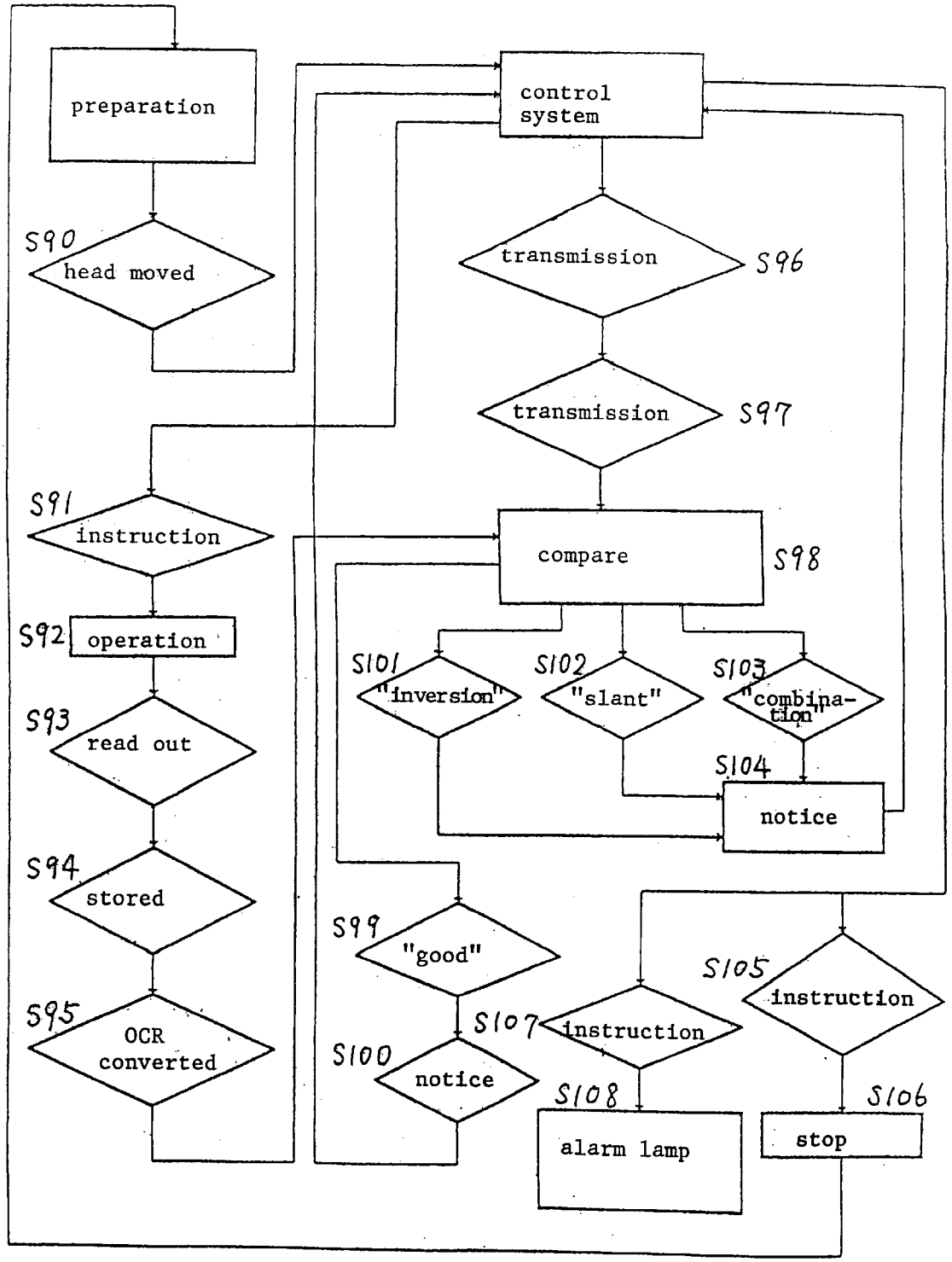
FIG. 19 is a flow chart of function for identifying in the apparatus in FIG. 18.

In the embodiment, after the preparation for starting the book binder, the apparatus moves the reading heads to the preset positions, the notice of movement being given to the book binder control system (S90), as shown in FIG. 19. An instruction is given from the control system (S91) to start the operation of book binder (S92). The reading heads start to read out (S93). The read out data are stored in the memory (S94) and OCR-converted and/or image processed (S95).

The reference data are transmitted from the book binder control system (S96). The reference data comprise the item data and the additional data. The additional data include an information of combination relating to the feeding portion from which the printed sheet is fed and the position of the sheet at which the reading head reads out the item. The reference data are transmitted to the identifying means (S97). The identifying means compares the read out data with the reference data (S98) to determine it to be "good" (S99), "no good for page inversion" (S101), "no good for page slant" (S102) or "no good of combination" (S103). A notice of "good" is given to the book binder control system to continue the operation (S100) when determining it to be "good". A notice of "no good" is given to the book binder control system when determining it to be "no good for page inversion", "no good for page slant" or "no good of combination" (S104) so that an instruction of stop is given from the book binder control system (S105) to stop the book binder (S106), the control flow returning to the step S90 after the preparation of book binder control system. An instruction of alarm is given from the book binder control system (S107) when a notice of "no good" is given so that an alarm lamp and sound are lighted and produced (S108).

What is claimed is:

1. An apparatus for identifying a page of printing plate or printed product, the apparatus comprising:

reading head means for reading out at least one item in a restricted local descriptive portion of said page of printing plate or printed product, said reading head means comprising a CCD linear sensor and a light source which comprises LEDs; and identifying means for identifying said page of printing plate or printed product in accordance with the read out data transmitted from said reading head means.

2. The apparatus as set forth in claim 1 wherein said item includes a character, brief description, mark, patter, or figure indicating the page, edition, version or kind of printing plate or printed product.

3. The apparatus as set forth in claim 2 wherein said reading head means comprises a CCD linear sensor and a light source which comprises LEDs.

4. The apparatus as set forth in claim 2 further comprising a managing system by which the position and range of said local descriptive portion is preset, said item in said local descriptive portion being previously stored as reference data in said managing system, said identifying means comprising comparing means for comparing said read out data transmitted from said reading head means with said reference data transmitted form said managing system to identify said page of printing plate or printed product.

5. The apparatus as set forth in claim 4 further comprising moving means for moving said reading head means longitudinally of said CCD linear sensor into a reading position corresponding to said local descriptive portion, said reading position being preset by said managing system.

6. The apparatus as set forth in claim 5 wherein said printing plate or printed product is set up on a rotor, said CCD linear sensor extending axially of said rotor, said moving means moving said reading head means axially of said rotor into said reading position which is an axial position of said rotor, said local descriptive portion being defined with orthogonal axes X and Y of coordinates, one of the axes X extending axially of said rotor, the other axis Y extending circumferentially of said rotor, said reading head means having a reading range in one of the axes X, said reading range in one of the axes X being preset by the number of used pixel and the resolution of said CCD linear sensor, said reading head means starting to read out at a starting position in the other axis Y, a rotary encoder being mounted on the shaft of said rotor, said starting position in the other axis Y being preset by a counted value at a clock frequency synchronized with a signal output from said rotary encoder, said reading head means continuing to read out within a reading range in the other axis Y, said reading range in the other axis Y being preset by a counted value in a preset dividing ratio of a frequency of the signal output from said rotary encoder.

7. An apparatus for identifying a page of printing plate comprising:

reading head menas for reading out at least one of items in a restricted local descriptive portion of said page of printing plate, said reading head means comprising a CCD linear sensor and a light source which comprises LEDs, aid item including a character, brief description, mark, pattern or figure indicating the page, edition, version or kind of printing plate;

identifying means for identifying said page of printing plate in accordance with the read out data transmitted from said reading head means;

a managing system by which the position and range of said local descriptive portion is preset, said item in said local descriptive portion being previously stored as reference data in said managing system, said identifying means comprising comparing means for comparing said read out data transmitted from said reading head means with said reference data transmitted from said managing system to identify said page of printing plate; and moving means for moving said reading head means longitudinally of said CCD linear sensor into a reading position corresponding to said local descriptive portion, said reading position being preset by said managing system, said printing plate being set up on a rotor, said CCD linear sensor extending axially of said rotor, said moving means moving said reading head means axially of said rotor into said reading position which is an axial position of said rotor, said local descriptive portion being defined with orthogonal axes X and Y of coordinates, one of the axes X extending axially of said rotor, the other axis Y extending circumferentially of said rotor, said reading head means having a reading range in one of the axes X, said reading range in one of the axes X being preset by the number of used pixel and the resolution of said CCD linear sensor, said reading head means starting to read out at starting position in the other axis Y, a rotary encoder being mounted on the shaft of said rotor, said starting position in the other axis Y being preset by a counted value at a clock frequency synchronized with a signal output from said rotary encoder, said reading head menas continuing to read out within a reading range in the other axis Y, said reading range in the other axis Y being preset by a counted value in a preset dividing ratio of a frequency of the signal output from said rotary encoder, said rotor comprising a plate cylinder in a printing press, said printing plate being set up on said plate cylinder, said reading head means being located adjacent to said plate cylinder.

8. The apparatus as set forth in claim 5 wherein said printing plate or printed product is fed in a feeding direction, said CCD linear sensor extending perpendicular to said feeding direction, said local descriptive portion being defined with orthogonal axes X and Y of coordinates, one of the axes X extending perpendicular to said feeding direction, the other axis Y extending parallel to said feeding direction, said reading head means starting to read out at a starting position in the other axis Y, said starting position in the other axis Y being preset by a counted value of scanning lines which start to be counted at the leading edge of said printing plate or printed product.

9. An apparatus for identifying a page of printing plate comprising:

reading head means for reading out at least one of items in a restricted local descriptive portion of said page of printing plate, said reading head means comprising a CCD linear sensor and a light source which comprises LEDs, said item including a character, brief description, mark, pattern or figure indicating the page, edition, version or kind of printing plate;

identifying means for identifying said page of printing plate in accordance with the read out data transmitted from said reading head means;

a managing system by which the position and range of said local descriptive portion is preset, said item in said local descriptive portion being previously stored as reference data in said managing system, said identifying means comprising comparing means for comparing said read out data transmitted from said reading head means with said reference data transmitted from said managing system to identify said page of printing plate; and moving means for moving said reading head means longitudinally of said CCD linear sensor into a reading position corresponding to said local descriptive portion, said reading position being preset by said managing system, said printing plate being fed in a feeding direction, said CCD linear sensor extending perpendicular to said feeding direction, said local description portion being defined with orthogonal axes X and Y of coordinates, one of the axes X extending perpendicular to said feeding direction, the other axis Y extending parallel to said feeding direction, said reading head means starting to read out at a starting position in the other axis Y, said starting position in the other axis Y being preset by a counted value of scanning lines which start to be counted at the leading edge of said printing plate, said reading head means being located adjacent to a feed roller by which said printing plate is delivered from a plate making or direct plate making apparatus.

10. The apparatus as set forth in claim 8 wherein said reading head means is located adjacent to a guide roller in a printing press.

11. An apparatus for identifying a page of printed product comprising:

reading head means for reading out at least one of items in a restricted local descriptive portion of said page of printed product, said reading head means comprising a CCD linear sensor and a light source which comprises LEDs, said item including a character, brief description, mark, pattern or figure indicating the page, edition, version or kind of printed product;

identifying means for identifying said page of printed product in accordance with the read out data transmitted from said reading head means;

a managing system by which the position and range of said local description portion is preset, said item in said local descriptive portion being previously stored as reference data in said managing system, said identifying means comprising comparing means for comparing said read out data transmitted from said reading head means with said reference data transmitted from said managing system to identify said page of printed product; and moving means for moving said reading head means longitudinally of said CCD linear sensor into a reading position corresponding to said local descriptive portion, said reading position being preset by said managing system, said printed product being fed in a feeding direction, said CCD linear sensor extending perpendicular to said feeding direction, said local descriptive portion being defined with orthogonal axes X and Y of coordinates, one of the axes X extending perpendicular to said feeding direction, the other axis Y extending parallel to said feeding direction, said reading head means starting to read out at a starting position in the other axis Y, said starting position in the other axis Y being preset by a counted value of scanning lines which start to be counted at the leading edge of said printed product, said reading head means being located adjacent to a passage through which said page of printed product is fed or dropped down in a saddle stitching book binder.

* * * * *

UNITED STATES PATENT AND TRADEMARK OFFICE

CERTIFICATE OF CORRECTION

PATENT NO. : 6,101,945

DATED : August 15, 2000

INVENTOR(S) : Akira Hara, Yoshio Tsukamoto, and Takeo Onda

It is certified that error appears in the above-indentified patent and that said Letters Patent is hereby corrected as shown below:

In Claim 2, line 2, "patter" should read --pattern--.

In Claim 7, line 3, "menas" should read --means--;

line 41, "menas" should read --means--.

Signed and Sealed this

Tenth Day of April, 2001

*Attest:*

Nicholas P. Godici

NICHOLAS P. GODICI

*Attesting Officer*

*Acting Director of the United States Patent and Trademark Office*